US005164550A

United States Patent [19]

Beidl et al.

[11] Patent Number: 5,164,550

[45] Date of Patent: Nov. 17, 1992

[54] INTAKE MUFFLER

[76] Inventors: Christian Beidl, Edelsbach 51, A-8063 Eggersdorf; Albin Sterbenz, Friedmanngasse 20, A-8041 Graz, Austria

[21] Appl. No.: 691,838

[22] Filed: Apr. 26, 1991

[30] Foreign Application Priority Data

Apr. 30, 1990 [AT] Austria ..... 984/90

[51] Int. Cl.[5] ..... F02M 35/00; F01N 7/00; F01N 1/24; F01N 1/08

[52] U.S. Cl. ..... 181/229; 181/238; 181/258; 181/265

[58] Field of Search ..... 181/229, 224, 238, 258, 181/265, 314

[56] References Cited

U.S. PATENT DOCUMENTS 4,782,912 11/1988 Wandless ..... 181/229
4,790,864 12/1988 Kostun ..... 181/229 X

FOREIGN PATENT DOCUMENTS 235089 8/1964 Austria .

*Primary Examiner*—L. T. Hix
*Assistant Examiner*—Khanh Dang
*Attorney, Agent, or Firm*—Collard, Roe & Galgano

[57] ABSTRACT

An intake muffler, which is particularly intended for use in two-stroke-cycle internal combustion engines, comprises a stiff housing, in which a partition defines two chambers. An inlet tube extends into the larger first chambr. At least two communicating tubes extend through the partiton. The second chamber communicates with a tubular outlet port. In order to ensure an effective damping of sound even in conjunction with a high engine power, the inlet tube consists of a diffuser, which is divided into two or more passages, and the tubes through which the two chambers communicate with each other differ in diameter and/or in length.

5 Claims, 2 Drawing Sheets

INTAKE MUFFLER

BACKGROUND OF THE INVENTION

1. Field of the Invention

This invention relates to an intake muffler, which is particularly intended for use in two-stroke-cycle internal combustion engines and comprises a stiff housing, in which a partition defines two chambers, which communicate with each other through at least two tubes, which extend through the partition, wherein the first chamber has a larger volume than the second and is provided with an inlet tube and contains an air filter insert and the second chamber communicates with a tubular outlet port.

2. Description of the Prior Art

A muffler of that kind, which is known from practice, comprises a cylindrical, non-partitioned inlet tube and in most cases there is only a single communicating tube. If there are two or more of such communicating tubes, they are equal in diameter and in length and the muffler is flown through only in one direction.

A disadvantage of that known muffler resides in that there is a high pressure drop in relation to the tube length, which results in desirable acoustic properties, and in relation to the tube diameter, which is also favorable from an acoustic aspect. That high pressure drop will obviously reduce the power of the engine. The presence of the single communicating tube or of a plurality of communicating tubes which are equal in length involve a risk of an occurrence of pronounced natural frequencies, which will give rise to unpleasant noise and to a higher sound level. Because the muffler is flown through only in one direction, there is only a poor damping of sound owing to a lack of appropriate reflections.

From Austrian Patent Specification 235,089 it is also known to connect the several chambers of a sound-damping filter by means of tubes which differ in length and in diameter. But that known muffler is of an entirely different design and comprises a pure air chamber, an adjacent secondary damping chamber, an intermediate damping chamber, and a primary damping chamber. The pure air tube leads from the pure air chamber directly to the outlet and has only slots in the intermediate chamber and in the primary damping chamber and a relatively short tube which is smaller in diameter extends from the pure air chamber only into the secondary damping chamber, which has no outlet opening. That known muffler constitutes a relatively intricate sheet metal structure, which results in entirely different conditions.

SUMMARY OF THE INVENTION

For this reason it is an object of the invention to provide an intake muffler which is of the kind described first hereinbefore and which ensures an effective damping of sound even in conjunction with a high engine power.

The object set forth is accomplished by the invention in that the inlet tube consists of a diffuser, which is divided into two or more passages, and the tubes through which the two chambers communicate with each other differ in diameter and/or in length.

Because the inlet tube consists of a diffuser, the pressure drop will be smaller whereas there is no need for a larger diameter, which would involve a deterioration of the acoustic properties. The passages differing in length which are provided in the diffuser will improve the damping of sound by interference. Because the communicating tubes have different dimensions, an occurrence of pronounced natural frequencies will be suppressed so that the damping of sound will be further improved.

According to a further feature of the invention the inlet tube which constitutes the diffuser is so arranged relative to the communicating tubes and the latter are so arranged relative to the tubular outlet port that the direction of flow is reversed in the first chamber and/or in the second chamber. In that case the damping of sound will be further improved by additional reflections without a need for an increase of the cross-sectional areas and/or volumes.

It will be particularly desirable to provide in the second chamber a damping insert, which is separated from the adjacent housing wall by an air gap. That damping insert will reduce the transmission of sound to the housing and, as a result, a radiation of sound from the outside surface of the housing.

Tubes and passages which differ in length can simply be provided in that the outlet end of the inlet tube and at least one of the two ends of each communicating tube have a rim which extends in a plane that includes an oblique angle with the axis of the tube concerned.

DETAILED DESCRIPTION OF THE PREFERRED EMBODIMENT

Figure 1:
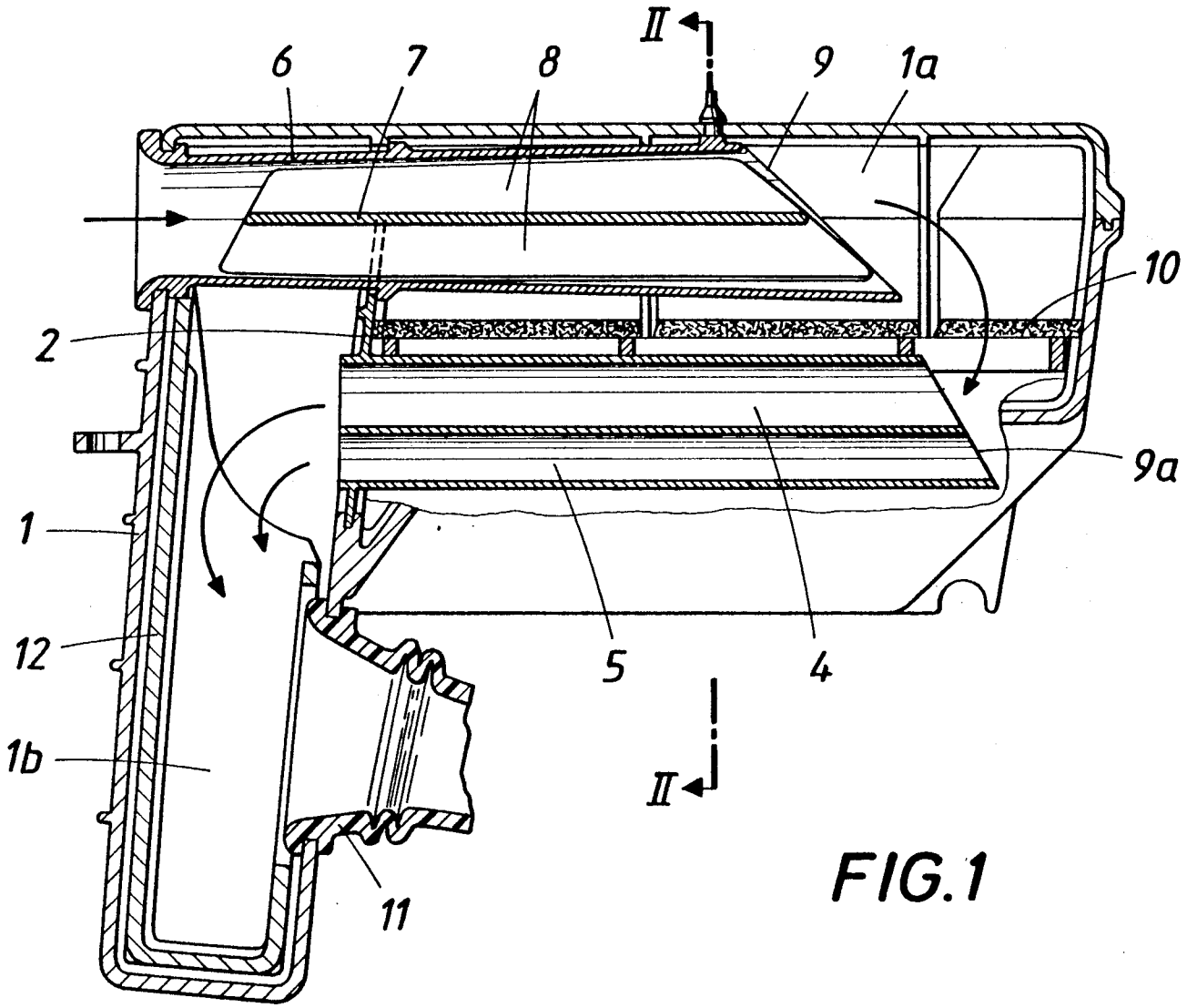
FIG. 1 is a longitudinal sectional view taken on line I—I in FIG. 2 and shows an intake muffler.
Figure 2:
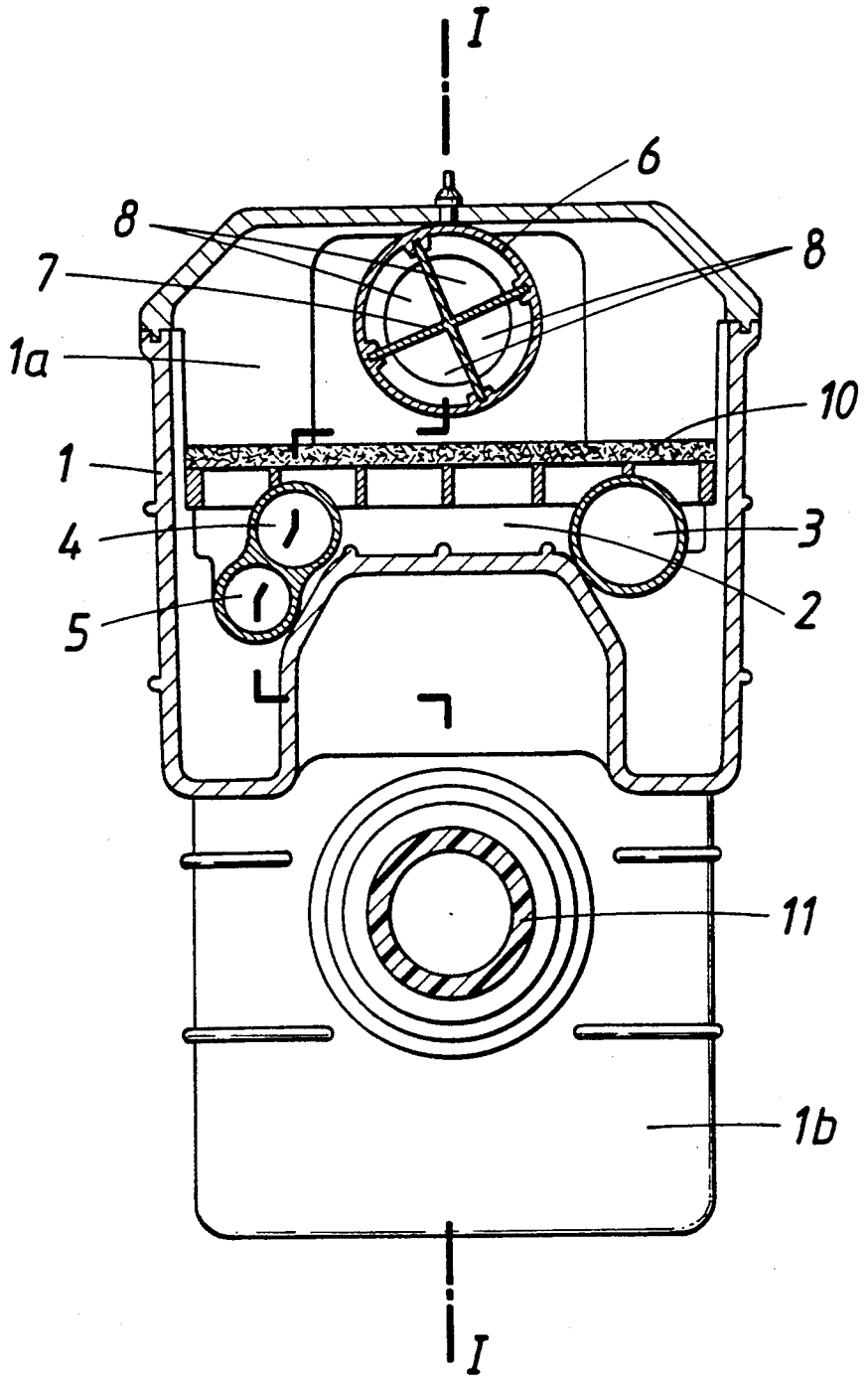
FIG. 2 is a corresponding transverse sectional view taken on line II—II in FIG. 2.

An illustrative embodiment of the invention will now be described more in detail with reference to the drawing.

The intake muffler comprises a stiff housing 1, which is divided into two chambers 1*a*, 1*b* by a partition 2, through which three communicating tubes 3, 4, 5 extend from the first chamber 1*a* into the second chamber 1*b*. The first chamber 1*a* contains an inlet tube 6, which constitutes a diffuser, in which a cross-shaped insert 7 defines four passages 8, which differ in length because the outlet end of the inlet tube 6 has a rim 9, which extends in a plane that includes an oblique angle with the axis of the inlet tube 6. An air filter 10 is contained in the first chamber 1*a*.

The three communicating tubes 3, 4, 5 differ in diameter and at one end have a rim 9*a*, which extends in a plane that includes an oblique angle with the axis of the tube so that the tube 3, 4 and 5 also differ in length. A tubular outlet port 11 leads from the second chamber 1*b* to the internal combustion engine. The inlet tube 6 is so arranged relative to the communicating tubes 3, 4 and 5 and the latter are so arranged relative to the tubular outlet port 11 that the direction of flow of the air which has entered through the inlet tube 6 will be reversed in the first chamber 1*a*, which is larger in volume, and in the second chamber 1*b*. To reduce the transmission of sound to the housing 1 and thus to reduce the radiation of sound from the outside surface of the housing, the second chamber 1*b* contains a sound-damping insert 12, which is separated by an air gap from th adjacent wall of the housing.

We claim:

1. In an intake muffler comprising a stiff housing, a partition contained in said housing and defining in said housing first and second chambers, the first of which has a larger volume than the second, at least two communicating tubes, which extend through said partition and through which said chambers communicate with each other, an inlet tube, through which said first chamber communicates with the outside of the housing, an air filter contained in said first chamber, and a tubular outlet port communicating with said second chamber, the improvement residing in that said inlet tube consists of a diffuser, which contains at least two passages extending along said inlet tube and differing in length, and said communicating tubes differ in at least one of the dimensions consisting of the diameter and the length of said communicating tubes.

2. The improvement set forth in claim 1 as applied to an intake muffler for use in a two-stroke-cycle internal combustion engine.

3. The improvement set forth in claim 1, wherein said inlet tube, which constitutes said diffuser, and said tubular outlet port are so arranged relative to said communicating tubes that the flow of air in said housing from said inlet tube to said tubular outlet port will be reversed in at least one of said first and second chambers.

4. The improvement set forth in claim 1, wherein said second chamber contains a sound-damping insert, which is separated by an air gap from an adjacent portion of said housing.

5. The improvement set forth in claim 1, wherein said inlet tube has an axis and has in said first chamber an outlet end and has at said outlet end a rim which extends in a plane that includes an oblique angle with the axis of said inlet tube, and each of said communicating tubes has an axis and has two ends in said first and second chambers, respectively, and at least at one of said ends has a rim which extends in a plane that includes an oblique angle with the axis of said communicating tube.

* * * * *